US011019906B2

(12) United States Patent
Tammel et al.

(10) Patent No.: US 11,019,906 B2
(45) Date of Patent: Jun. 1, 2021

(54) HYGIENIC COSMETIC APPLICATOR AND METHOD OF USE

(71) Applicant: John H. Shadduck, Menlo Park, CA (US)

(72) Inventors: Amelia Tammel, Glendale, CA (US); John H. Shadduck, Menlo Park, CA (US)

(73) Assignee: John H. Shadduck, Menlo Park, CA (US)

( * ) Notice: Subject to any disclaimer, the term of this patent is extended or adjusted under 35 U.S.C. 154(b) by 0 days.

(21) Appl. No.: 16/715,971

(22) Filed: Dec. 16, 2019

(65) Prior Publication Data

US 2020/0187623 A1 Jun. 18, 2020

Related U.S. Application Data

(60) Provisional application No. 62/780,657, filed on Dec. 17, 2018.

(51) Int. Cl.

| | |
|---|---|
| ***A45D 33/34*** | (2006.01) |
| ***A45D 34/04*** | (2006.01) |
| ***A45D 40/26*** | (2006.01) |

(52) U.S. Cl.

CPC ..... *A45D 33/34* (2013.01); *A45D 34/04* (2013.01); *A45D 40/26* (2013.01); *A45D 2200/1009* (2013.01); *A45D 2200/1018* (2013.01)

(58) Field of Classification Search

CPC .... A45D 33/005; A45D 33/006; A45D 33/34; A45D 33/36; A45D 34/04; A45D 34/041; A45D 40/26; A45D 40/262; A45D 40/28; A45D 40/1009; A45D 40/1018; A45D 40/1045; A45D 40/1036; A45D 40/1054; A45D 40/1063; A47L 13/16; A47L 13/17; A47K 7/02; A47K 7/03

USPC ..... 15/104.93, 104.94, 208, 209.1, 210.1, 15/229.14, 244.1, 244.3, 2, 44.4; 132/320

See application file for complete search history.

(56) References Cited

U.S. PATENT DOCUMENTS

| | | | | |
|---|---|---|---|---|
| 3,337,895 A * | 8/1967 | Clements | ..... | A45D 33/34 15/229.14 |
| 3,568,236 A * | 3/1971 | Aston | ..... | A45D 40/28 15/244.1 |
| 6,006,761 A * | 12/1999 | Meledandri | ..... | A45D 33/34 132/317 |

(Continued)

OTHER PUBLICATIONS

Duan, G. et al., "Ultralight, Soft Polymer Sponges by Self-Assembly of Short Electrospun Fibers in Colloidal," *Advanced Functional Materials*, 25(19), pp. 2850-2856, Mar. 30, 2015.

(Continued)

*Primary Examiner* — Mark Spisich

(74) *Attorney, Agent, or Firm* — Levine Bagade Han LLP

(57) ABSTRACT

Hygienic cosmetic applicators, blenders and aids, and more particularly to a soft, resilient blender system that includes an open-cell memory foam surface component that is easily cleanable or disposable in combination with a core resilient component that is fluid impermeable. Hygienic cosmetic applicators, blenders and aids including a core component with one or more spring elements for greatly accelerating the rebound of the blender surface from a compressed state to a repose memory state.

11 Claims, 6 Drawing Sheets

(56) References Cited

U.S. PATENT DOCUMENTS

2018/0070700 A1* 3/2018 Choi ..... B32B 25/18

OTHER PUBLICATIONS

Haerst, M. et al., "Silicone Fiber Electrospinning for Medical Applications," 6th European Conference of the International Federation for Medical and Biological Engineering Proceedings, vol. 45, pp. 537-540, 2015.

* cited by examiner

HYGIENIC COSMETIC APPLICATOR AND METHOD OF USE

RELATED APPLICATION INFORMATION

This application is a non-provisional application of U.S. Provisional Application No. 62/780,657 filed on Dec. 17, 2018. The entirety of which is incorporated by reference.

BACKGROUND OF THE INVENTION

1. Field of the Invention

The present invention relates to hygienic cosmetic applicators, blenders and aids, and more particularly to a soft, resilient blender system that includes an open-cell memory foam surface component that is easily cleanable or disposable in combination with a core resilient component that is fluid impermeable. Further, the core component of the system includes spring elements for greatly accelerating the rebound of the blender surface from a compressed state to a repose memory state.

2. Description of the Background Art

Professional makeup artists often work in fast-paced environments where there is a need to apply makeup to several models or actors in rapid succession, particularly in the fashion, theatre and television industries. Such makeup artists may spend a considerable amount of time cleaning and preparing their makeup tools when working with multiple clients over a short period of time. With the advent of new technologies in high resolution digital cameras and video, there is an increasing need for professionally blended face and body makeup.

Cosmetic applicators known as makeup sponges or blenders are well known and are a mainstay of a makeup artist's toolkit. The commercially available makeup sponges or blenders typically consist of a latex or urethane foam sponge 50 as shown in FIG. 3, wherein the sponge consists of a uniform density open cell foam and may have a variety of shapes and sizes.

There are several disadvantages involving the use of the currently available sponges and blenders. In normal use, a sponge or blender is dabbed continuously against the recipient's skin where cosmetic materials are picked up by open cells of the blender surface and then released back onto the skin surface as the blender is moved to thus blend the cosmetic material.

First, many blenders during use our are impregnated with large amounts of cosmetic material, which can be wasteful and costly. If too much cosmetic material is impregnated in the applicator, it may be difficult to blend the cosmetic material uniformly. On the other hand, if the amount of cosmetic material retained by the applicator is too small, then blending may take longer and still may not be uniform. The designs of blenders have been adjusted to improve the amount of cosmetic material impregnated into the sponge surface during use, mainly by experimenting with the size and density of pores in the open cell foam that comprises the blender. Typically, the open cell foam blenders that are commercially available have very small pores which are adapted to hold water before use to moisturize the sponge. In use, the dabbing motion can cause the cosmetic material to migrate through the entire sponge. Thereafter, cleaning the sponge is problematic as the makeup material can migrate throughout the sponge. Further, the complete drying such blender sponges can take hours due to the very small pore size in such blenders.

Further, from the viewpoint of hygiene, bacteria can easily grow inside the pores of the blender, especially when liquid cosmetic material is applied, because the material can permeate through the entire foam body of the applicator.

Another potential disadvantage of currently available open cell foam blenders relates to their use with anticipated new forms of makeup materials, some of which are being contemplated by the author, which may be termed herein as microbiome cosmetics. While not widely used today, it is anticipated that makeup materials such as primers, etc. will be used that carry living microorganisms, i.e., the microbiome. When using an open cell blender after the application of microbiome cosmetics, it will be inevitable that such living microorganisms will migrate throughout the sponge which again may make thorough cleaning and drying more important. Further, it is possible that such applicators would require regulatory clearance for sterilization when used to apply microbiome materials to a recipient's face.

An additional disadvantage of current open cell foam blenders relates the uniformity of the resilient open cell foam material and the slow rebound of such memory foams from a compressed or tensioned state to its repose memory shape. In use, a makeup artist also could find it useful to have different density foams with different force/compression characteristics for blending in different area of a recipient's face, for example, softer foam for use around the eyes and less soft foam for use in other locations. Further, it would also be very useful to have faster rebounding foam which could speed up the blending of makeup.

What is needed is:

- a cosmetic applicator or blender configured for very rapid cleaning and drying after each use to provide for completely hygienic makeup applications;
- a cosmetics applicator or blender with a surface topology and porosity suited for blending makeup without excessive impregnation of the makeup into the applicator to limit waste of cosmetic materials;
- a cosmetics applicator or blender adapted for use with microbiome cosmetics which carries limited volumes of such live cultures to conserve expensive products and that is easily cleanable or sterilizable;
- a cosmetics applicator or blender with a surface structure adapted to absorb a specific amount of water to allow for consistent level of moisture in the applicator for specific types of makeup;
- a cosmetics applicator or blender for makeup artists that can be inexpensive and adapted for single use that has all needed features for controlled moisture content, feel on the skin, and adapted for limiting waste of cosmetic materials;
- a cosmetics applicator or blender that provides a makeup-carrying surface with much faster rebound characteristics for speeding up the blending of makeup materials; and
- a cosmetics applicator or blender with at least two different surface portions with different force/deformation characteristics for differential blending/dabbing with a single applicator.

The several variations of present invention described below provide a cosmetics applicator or blender that solves the aforementioned problems.

SUMMARY OF THE INVENTION

The features described herein various novel details of construction and combinations of parts, and other advantages, will be described with reference to the accompanying drawings and claims. It is understood that the particular methods and devices conveying the inventive features are shown by way of illustration and not as a limitation of the invention. The principles and features of this invention may be employed in various and numerous embodiments without departing from the scope of the invention.

The present disclosure includes improved cosmetic applicators. For example, such an applicator can include a resilient body shaped for gripping with the fingers of a user; a surface portion of the body comprising a porous memory foam having a first inherent rebound characteristic to rebound from a compressed tensioned shape to a repose memory shape; and a core portion of the body comprising at least one spring element imparting to the body a second rebound characteristic that differ from the first inherent rebound characteristic.

Another variation of a cosmetic applicator can include a resilient body having a central axis adapted and shaped for gripping with the fingers of a user; a surface portion of the body comprising a fluid permeable layer overlying a fluid impermeable layer; an interior portion of the body including at least one spring element for imparting to the body a selected rebound parameter for rebounding the body from a compressed tensioned shape to a decompressed repose shape.

A variation of the cosmetic applicator can include a configuration where the second rebound characteristic consists of a second rebound rate that is faster than a first rebound rate of the first inherent rebound characteristic. For example, the second rebound rate can be faster than that first rebound rate by at least 1.5 times, at least 2 times, at least 3 times, or at least 5 times.

In another variation, the cosmetic applicator is configured such that the surface portion is detachably coupled to the core portion. Alternatively, the surface portion can be fixed to the core portion.

In another variation, an interface between the surface portion and the core portion is fluid impermeable.

Variations of the cosmetic applicator can include a ratio of a total interior volume of the surface portion of memory foam relative to a spatial volume of the resilient body is less than 0.4:1, less than 0.3:1, less than 0.2:1 or less than 0.1:1.

Variations of the device include applicators where the at least one spring element comprises a helical spring. Alternatively, or in combination, the at least one spring element comprises a plurality of spring elements.

The cosmetic applicators described herein can include a plurality of spring elements. In variation of the device, the plurality of spring elements is spaced apart about said central axis. In additional variations, the plurality of spring elements is asymmetrically spaced apart about said central axis. Alternatively, the spring elements can differ in orientation relative to the central axis. The spring elements can vary in terms of spring elements differ in spring strength or spring constant.

Another variation of a cosmetic applicator includes a resilient compressible body having a central axis adapted and shaped for gripping with the fingers of a user, the body having a first compressibility parameter when compressed about the central axis and a second compressibility parameter when compressed at an angle relative to the central axis.

In another variation, the cosmetic applicator includes a body that has at least a third compressibility parameter when compressed at a different angle relative to the central axis.

Variations of cosmetic applicators described herein can include an electrospun fiber sponge and/or an electrospun silicone sponge. In some cases the electrospun fibers have a diameter less than 50 μm or less than 20 μm.

BRIEF DESCRIPTION OF THE DRAWINGS

In order to better understand the invention and to see how it may be carried out in practice, some preferred embodiments are next described, by way of non-limiting examples only, with reference to the accompanying drawings, in which like reference characters denote corresponding features consistently throughout similar embodiments in the attached drawings.

DESCRIPTION OF THE INVENTION

Figure 1:
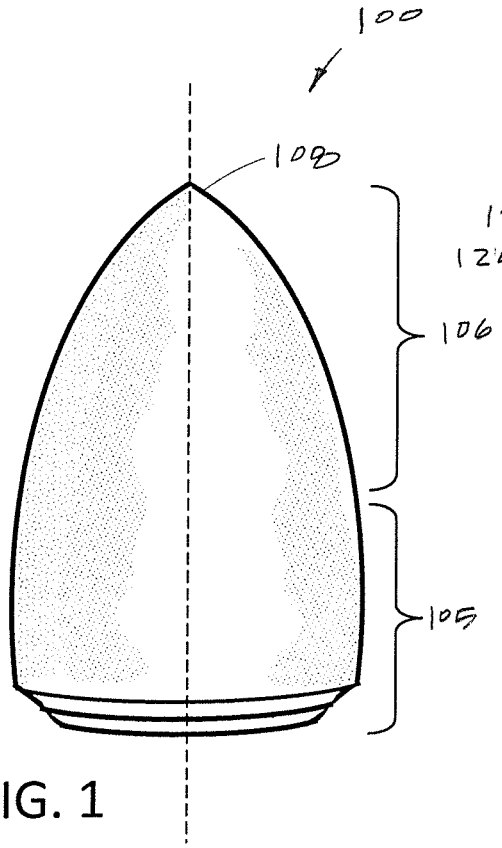
FIG. 1 is a perspective view of a cosmetic applicator or blender corresponding to the invention.
Figure 3:
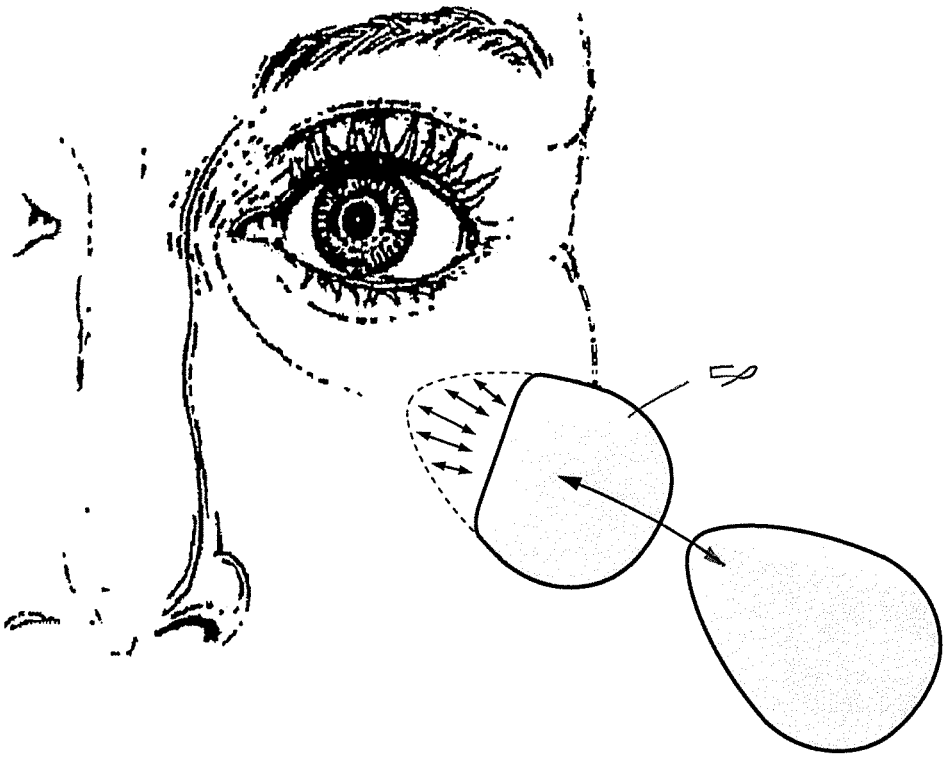
FIG. 3 (PRIOR ART)
FIG. 3 is a schematic view of a method of using a prior art sponge blender in dabbing cosmetic materials on a recipient's skin.

FIG. 1 shows a cosmetics applicator, tool or blender 100 corresponding to the invention which is adapted for gripping with a user's fingers and then typically used in a dabbing or stippling motion to blend and apply cosmetic materials to a recipient's face (cf. FIG. 3). The shape and contours of the blender can vary and in one embodiment shown in FIG. 1, the applicator has a proximal portion 105 that is generally gripped with the user's fingers and a distal portion 106 that tapers to a rounded or sharp apex 108. The blender or applicator of FIG. 1 comprises a soft, compressible, resilient body as can be easily understood. While the blender of FIG. 1 is rounded and tapers to distal apex 108, various flat, polygonal and planar variations are possible. The length dimension of the applicator 100 may range from about 20 mm to 60 mm but any dimensions are possible for different makeup blending purposes. Other shapes are described in additional embodiments below.

Figure 2A:
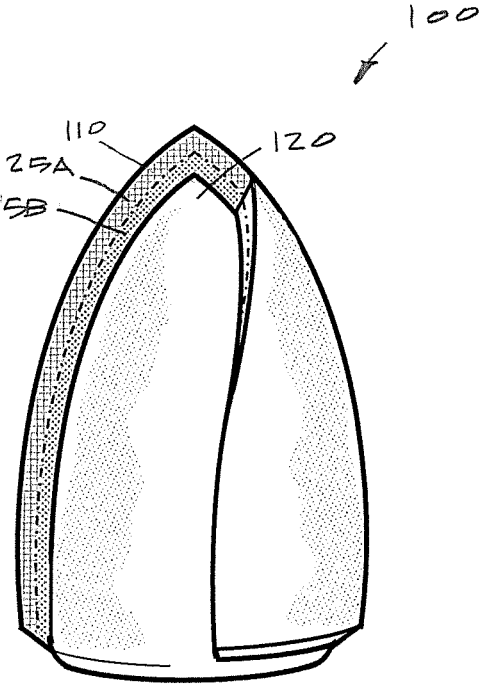
FIG. 2A is a perspective cut-away view of the blender of FIG. 1 showing an open cell surface component is removable from the fluid impermeable core component.
Figure 2B:
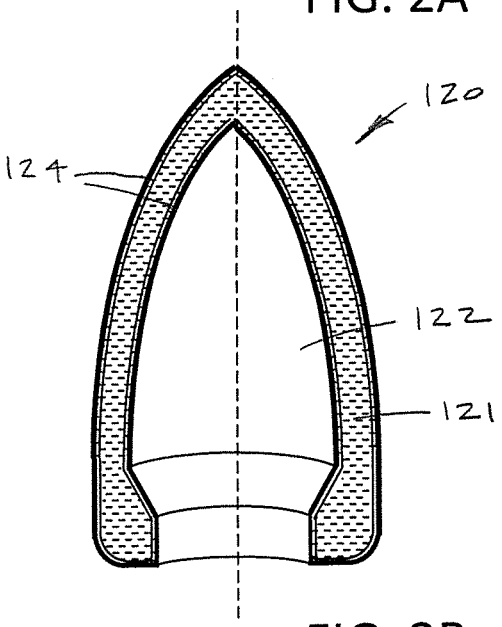
FIG. 2B is a sectional view of the resilient core component of the blender of FIGS. 1 and 2A showing an open interior space in the core component.

In FIG. 2A, it can be seen that the cosmetics applicator or blender 100 of FIG. 1 has a surface component or portion that 110 that comprises a soft, resilient open cell structure and typically is a open cell foam or sponge, often called a memory form. In other variations, at least a portion of the surface component 110 can comprise other open cell structures such as a microfabricated polymer or a layer electrospun fibers as will be described below. The surface component 110 interfaces with the core component or portion 120 of the blender 100 which also is soft and resilient. As can be seen in FIG. 2B, the core component 120 in one variation is an open cell foam 121 with open interior space 122. In this variation, the surfaces of the core component 120 comprise a fluid impermeable layer 124 (FIG. 2B). In other variations described below, the core component 120 can comprise a body or structure that is a foam block without the interior open space and is configured with the same compressibility and resilient characteristics with fluid impermeable surface layer.

Now referring to FIG. 2A, in one variation, the open cell surface component 110 comprises a first outer layer 125A and the second inner layer 125B which have different dimensions of the open cell structure and may also differ in material characteristics such as hydrophobicity. The first outer layer 125A is configured with open cells that have a selected dimension adapted to receive, carry and blend makeup materials therein as the blender surface is used in a dabbing fashion against the users skin as shown in FIG. 3. In one variation, the first outer layer 125A can have a thickness of 0.2 mm to 5.0 mm a more often from 0.5 mm to 2.5 mm. The mean dimension of open cells in the outer layer 125A can a range between 100 μm and 500 μm.

Still referring to FIG. 2A, this variation of blender 100 has a second inner layer 125B of the surface component 110 that comprises an open cell structure adapted to carry water in a selected volume to provide moisture for applying or blending makeup material carried transiently by the first outer layer 125A when dabbed the recipient's skin as described above. In one variation, the second inner layer 125B can have a thickness of 0.5 mm to 10.0 mm and more often from 2.0 mm to 5.0 mm. The mean dimension of an open cell in the second inner layer can range between 5 μm and 250 μm. In the embodiment illustrated in FIG. 2A, the mean dimension the open cells in the second inner layer 125B are significantly smaller than the mean dimension of the open cells in the first outer layer 125A, as the inner layer is configured to allow for the free flow water through both the first and second layers 125A, 125B. However, the smaller open cells of inner layer 125B are adapted to reduce or prevent the migration of makeup materials (powder or fluid) through the first outer layer 125A and into the second inner layer 125B. In some variations, the second inner layer 125B is designed with very small open cell dimensions that can receive water but entirely prevent the movement of makeup material into such open cells. As described above, the outer surface layer 124 of the core component 120 is fluid impermeable so that any fluid absorption and makeup migration is prevented following material and fluid impregnation of the surface component 110.

Further, still referring to FIG. 2A, the material of the second inner layer 125B can be a hydrophobic material which will accept the migration of water therein but has the tendency the repel retained water which then assists in moving water droplets outward through the surface component 110, for example, when the blender is squeezed. Silicone is an example of a hydrophobic material that can be used in the second inner layer 125B. In contrast, in one variation, the first outer layer 125A can be a substantially hydrophilic foam material that does not resist carrying small amounts of water or makeup fluids therein.

Thus, it can be understood from FIGS. 1 and 2A, the open cell surface component 110 comprises only a small fraction of the entire cubic volume of the applicator 100 when in its repose or non-compressed shape as shown in FIGS. 1 and 2A. In one aspect of the invention, the open cell component 110 is less than 40% of the total spatial volume of the applicator or blender 100. More often, the total volume of the open cell component is less than 30% of the total spatial blender volume or less than 20% of the total spatial volume. In the embodiment shown in FIG. 1, the open cell component is less than 10% of the total spatial blender volume. The term spatial volume as used herein means the total volume of the spatial "envelope" defined by the blender without regard to the open interior space. The term total volume of the open cell component means the actual physical volume of such a component and not the volume of the envelope defined by the component.

Stated another way, in another aspect of the invention, it has been found that the retained water volume carried by the open cell structure (surface component) can be less than 20 mL or less than 10 mL and still provide adequate moisture for dabbing or blending of makeup. In contrast, prior art makeup sponges or blenders typically retain far greater volumes of water since the entire applicator is an open cell foam. Such applicators that retain significantly larger water volumes are undesirable since cleaning and drying such sponge-type applicators is time-consuming, and may result in the mold and bacteria growth in the sponge material if not properly cleaned and dried.

As can be understood from FIGS. 2A and 2B, after use, the outer blender component 110 can be removed from the core component 120. In one aspect of the invention, the makeup artist can simply dispose of the outer component 110 as it can be expensive. In another aspect of the invention, the makeup artist can clean, rinse and dry the outer component 110 which can be accomplished very quickly since there is a limited volume of open cell material that can carry water and makeup materials. The outer component 110 can be washed under a faucet and then also can be dried rapidly after squeezing out any water, since the outer component has a very limited volume of open cells and air can be exposed all sides of the component 110.

Figure 4:
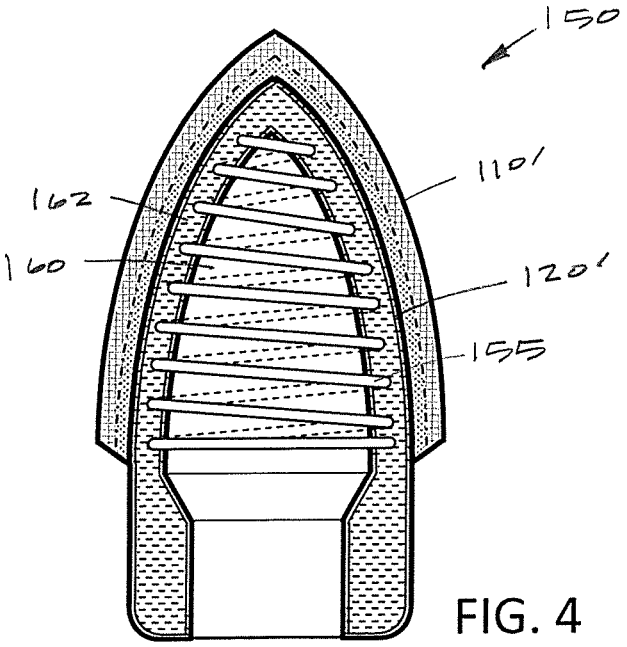
FIG. 4 is sectional view of another variation of blender similar to that of FIGS. 1-2B with a core component carrying an exemplary spring structure that is configured (i) to provide more rapid rebound during use to speed up the blending of cosmetic materials, and (ii) to provide a directional orientation to the blender's rebound to control and simplify the blending of cosmetic materials.
Figure 5A:
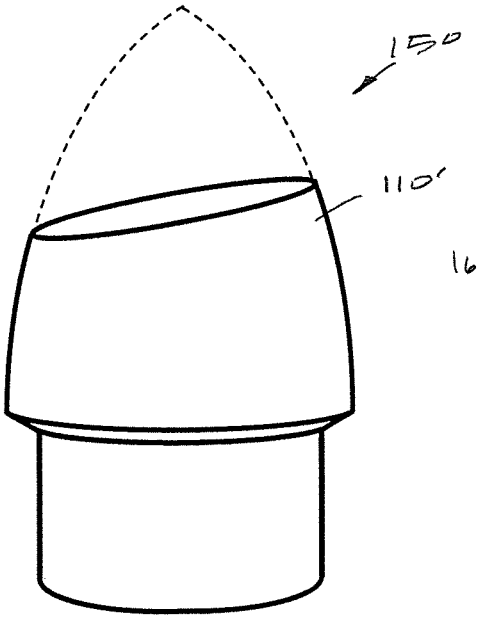
FIG. 5A is a perspective view of the blender of FIG. 4 showing the distal end of the blender or applicator partially compressed as when dabbing against a recipient's skin.

Now turning to FIG. 4, another variation of blender 150 is shown which can be used to apply and blend cosmetic materials as described above. In this variation, the surface component 110' of the blender can be similar to the embodiment of FIGS. 1-2B. The core component 120' again has the same functionality as shown in FIGS. 2A-2B, except the resilient structure has a different configuration that is adapted to greatly alter the resilient characteristics of the core component 120'. More in particular, in this variation, the core component 120' includes a resilient spring structure within a foam body which greatly amplifies the speed of the rebound of the blender from a deformed, tensioned state (FIGS. 5A-5B) to its memory, untensioned state (FIG. 4) which occurs repeatedly as the user dabs and blends the cosmetic materials. In one variation shown in FIGS. 5A-5B, the spring structure can comprise a metal helical spring 155 of a wire or ribbon spring steel, Nitinol or the like. As can easily be understood, a metal spring such as a helical spring 155 of FIG. 4 can rebound the tensioned shape much faster than a memory foam. In one variation, it is believed the spring 155 can rebound from the tensioned state at least five times faster than a memory foam, or least two times faster. As also can be understood, the spring 155 of FIG. 4 can be deformed sideways to a certain extent as well as being compressed vertically about the axis 158 of the spring 155. It should be appreciated that other spring structures maybe use for similar purposes, such as a plurality of helical springs or other non-helical forms of spring material. Such spring structures also they include metal wires or polymeric materials, braided materials and the like. Thus, the core component 120' of FIG. 4 functions in the same manner as a memory foam core, but can rebound far faster which can speed up the method of blending cosmetic materials.

In one variation shown in FIG. 4, it can be understood that the core component 120' has an open space 160 within the core. Further, the spring structure can be embedded within a foam element 162, but also can be carried in a sleeve element or can be a free-standing spring. In this aspect of the invention, the cleaning and drying of blended is again simplified since there is no large block of open cell foam as in prior art blenders.

A further advantage of the embodiment of FIG. 4 is that the blender core component 120' can be configured to collapse axially to be carried in a collapsed and reduced volume in a flat container. In many cases, users would find it advantageous to have a blender that can be carried in a flattened shape, for example, for carrying in a user's purse or makeup kit.

Figure 5B:
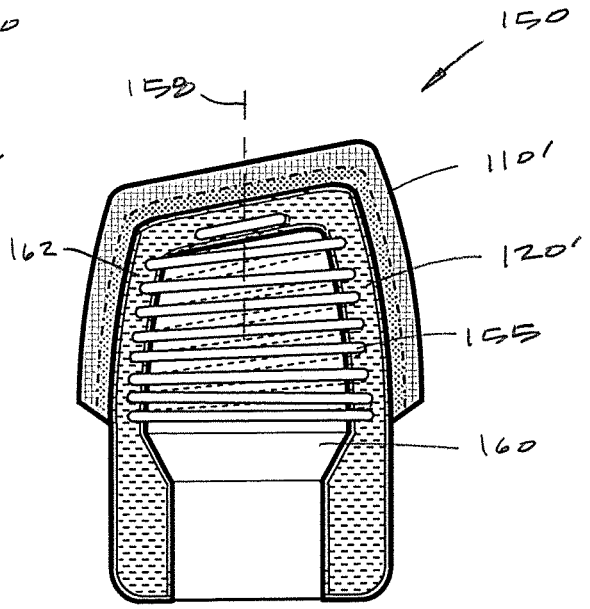
FIG. 5B is a sectional view of the blender of FIG. 5A showing the interior spring structure when partially compressed.

In the variation of FIGS. 4-5B, it should be appreciated that blenders of the type shown can be provided in a kit with a single core component 120' and a plurality of surface components 110' wherein each such surface component 110' differ from one another. It can be understood that the surface component 110' is inexpensive and optionally disposable, or designed for a limited number of uses. Such a surface component 110' can be inexpensive if made in a single material or slightly more expensive is fabricated with two layers as described above. In the event, a blender kit could have two or more surface components 110' that differ in thickness, density, porosity, moisture volume, moisture retention, hydrophobicity and other characteristics and the user can select among the optional surface components for particular makeup blending applications or based on personal preference. It has been found that cosmetic materials have various fluidic properties and particle dimensions and may be more easily blended with more or less moisture in the surface component 110'. The kit can also provide a graphic reminder of the particular service component 110' by making each service component a different color or having names, numbers or other characters on the component for viewing by the user.

Figure 6:
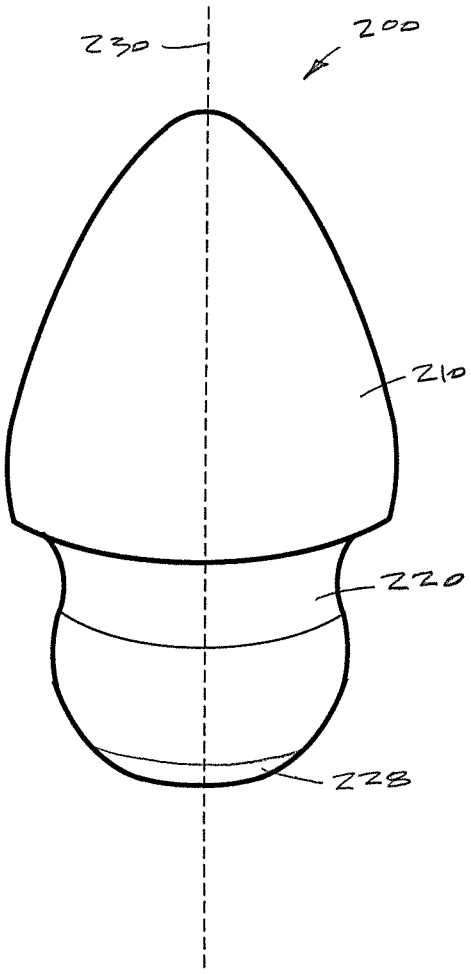
FIG. 6 is a perspective view of another variation of blender similar to that of FIGS. 4-5B with a grip portion that is spaced apart from the open cell foam component.
Figure 7:
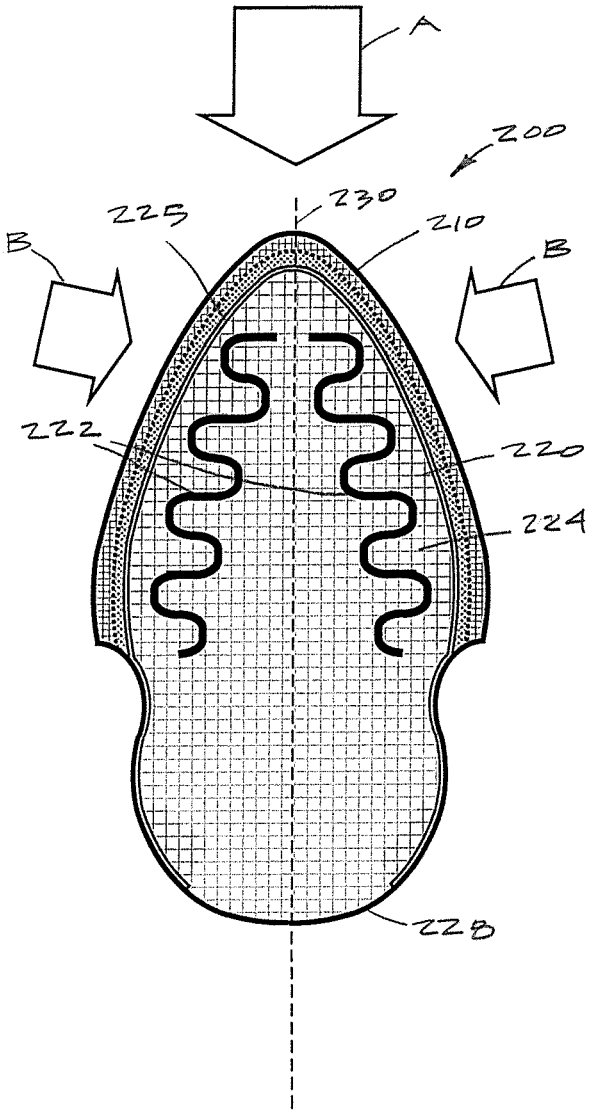
FIG. 7 is a sectional view of the blender of FIG. 6 showing the core component of an open-cell foam carrying a different form of spring structure.

Now turning to FIGS. 6-7, another variation of blender 200 is shown which is somewhat similar to the embodiment of FIGS. 4-5B. In this variation, the sectional view of FIG. 7 shows the surface component 210 and the core component 220 which has a plurality of spring elements 222 embedded therein. The core component 220 can be an open cell foam block 224. As described above, a fluid impermeable layer 225 is provided at the interface between the core component 220 and the surface component 210. In order for the core component 220 to be compressed, it is obvious that a portion of the core 220 and foam block 224 must be exposed to the exterior environment to allow airflow out of and into the open cell core. Thus, as can be seen in FIG. 7, a proximal portion 228 of the core component 220 and foam block 224 is exposed without the fluid impermeable layer 225. In order to allow for rapid airflow into and out of the core component, the exposed surface area indicated at 228 must be sufficiently large to allow for rapid compression and decompression of the core 220. For this reason, exposed surface area should be at least 5 $mm^2$ or at least 10 $mm^2$.

Of particular interest, the variation of FIGS. 6-7 has a different form of spring structure where a plurality of springs 222 or attached spring elements are spaced out around the central axis 230 of the blender. The individual spring elements 222 are designed to respond to deflection both axially and transverse to the axis in different manners. For example, it would be advantageous to provide a first selected force/deformation characteristic about the axis 230 and the second selected force/deformation characteristic and angular transverse to the axis 230. This will allow the user to dab axially with first deformation and response characteristics, and then to switch used to dab sideways with second information in response characteristics. It has been found that different deformation and response parameters are useful for different area of the recipient's skin surface. For example, it may be better to use a softer deformation and response portion of the blender around the recipient's eyes, and then a stronger deformation and response portion around other portions of the recipient's face. Thus, the single blender 200 can be used in two different vectors depending on the user preference, with arrows A and B in FIG. 7 indicating two different directions of dabbing which provide the first and second response characteristics.

Figure 8:
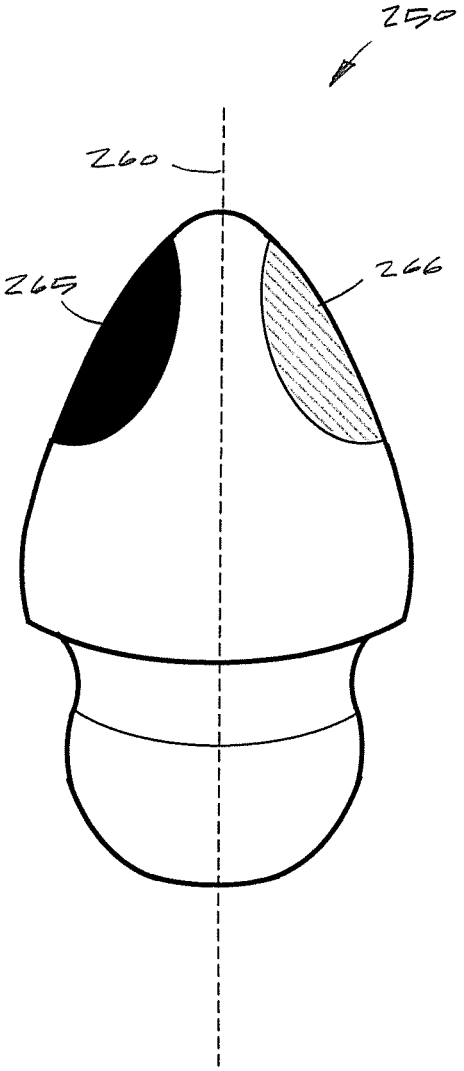
FIG. 8 is a perspective view of another variation of blender similar to that of FIGS. 6-7 except having an asymmetric internal spring structure for providing different force/deformation characteristics at various surface portions, and graphic indicators on the blender surface indicating the different surfaces.
Figure 9:
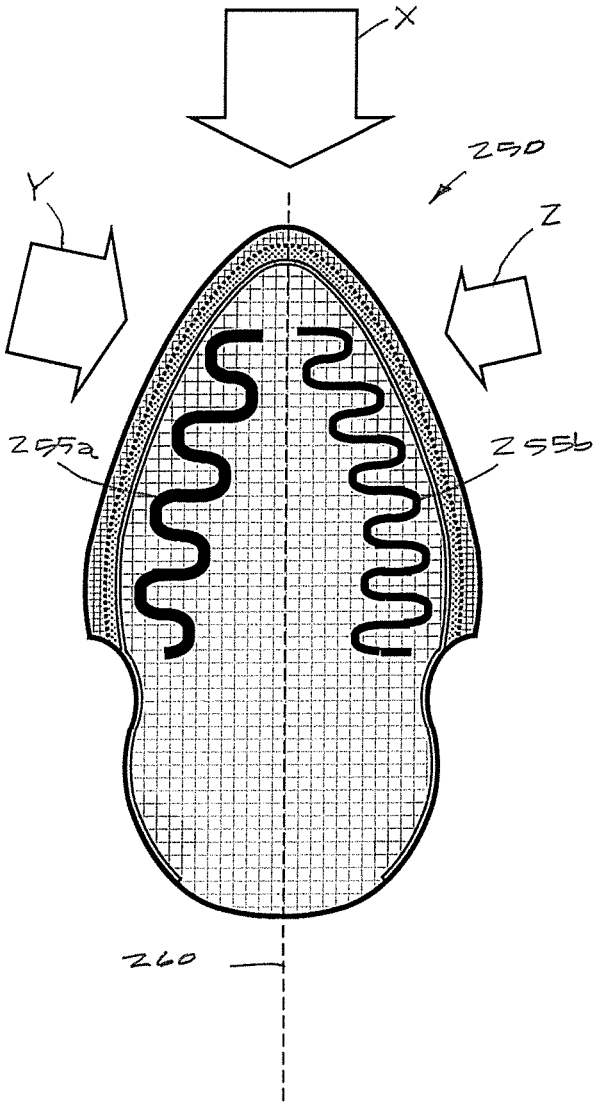
FIG. 9 is a sectional view of the blender of FIG. 7 showing the core component with the asymmetric internal spring structure.

FIGS. 8 and 9 illustrate another variation of blender 250 which is similar to the embodiment of FIGS. 6 and 7. In this variation, the sectional view of FIG. 9 shows an asymmetric spring structure where a plurality of different springs or attached spring elements 255*a*, 255*b* are disposed around the central axis 260 of the blender. These individual spring elements 255*a*, 255*b* are then designed to respond to deflection both axially and transverse to the axis with a plurality of force/deformation characteristics. The number of spring element can range from 2 to 20 or more. In one variation, as shown in FIG. 9, the asymmetric spring arrangement provides first, second and third selected force/deformation characteristics (X, Y, Z) about the axis 260. Thus, the user can rotate the blender to dab axially or at an angle to the axis to use anyone of three deformation and response characteristics to optimize makeup blending. Thus, the single blender 250 can be used in at least three different vectors depending on the user preference, with arrows X, Y and Z in FIG. 9 indicating different directions of dabbing to provide the desired response characteristics. Graphic indicators such as colors 265 and 266 on the surface of the blender can show the different portions of the blender with different flexing and response characteristics.

Figure 10:
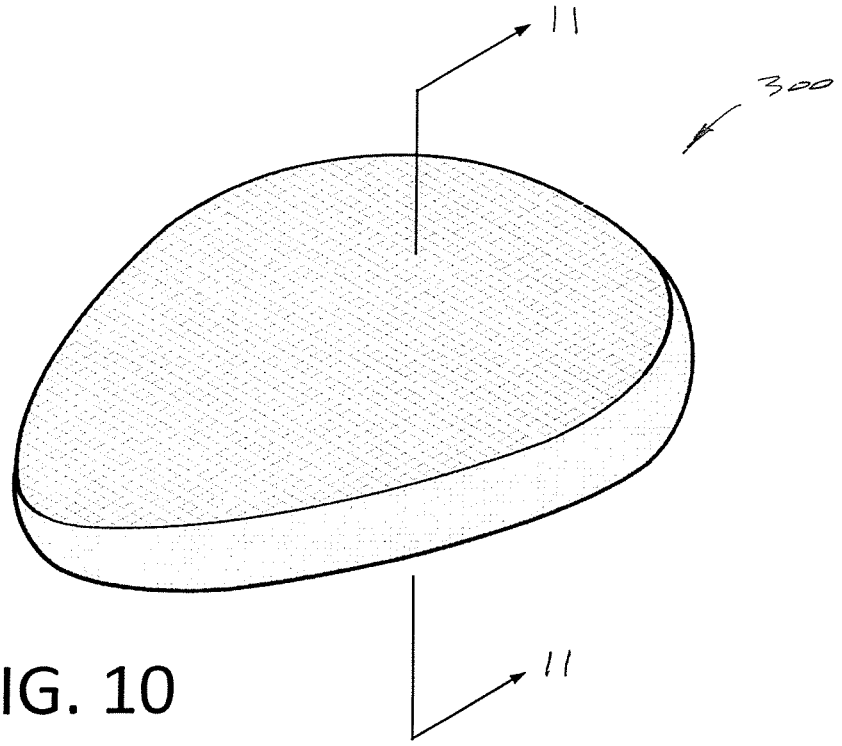
FIG. 10 is a perspective view of another variation of blender having a flattened configuration.
Figure 11:
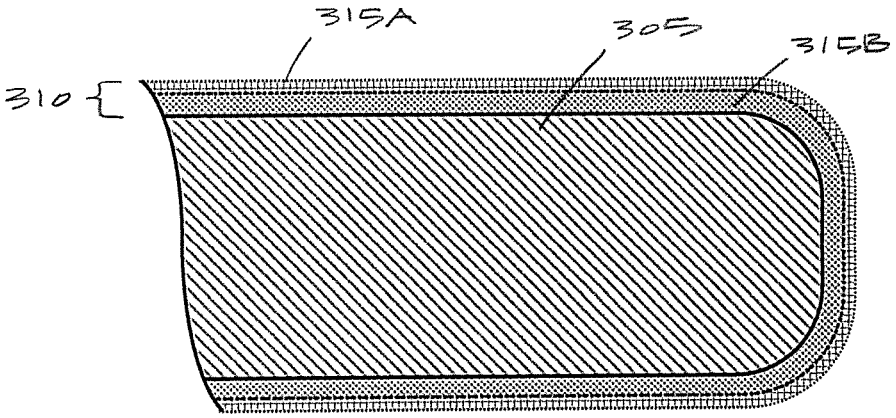
FIG. 11 is a sectional view of the blender of FIG. 10 taken along line 11-11 of FIG. 10 showing a resilient solid core surrounded by a porous surface component having a plurality of layers with differing porosities and surface characteristics, which can be electrospun fibers.

FIGS. 10 and 11 illustrate another variation of blender 300 which consists of a flattened resilient body with surface elements or layers as described in earlier variations above. For example, the blender core 305 (FIG. 11) can be a flexible, nonporous silicone material or the like. The surface component 310 can be detachable or bonded to the blender core 305. In this variation, the surface component 310 again can include a first porosity outer layer 315A and the second different porosity inner layer 315B, for example a hydrophobic layer as described above. In this variation, the blender 300 again would be easy to clean and dry because of the limited volume of the porous surface layer or layers. In one variation, either or both of layers 315A and 315 of the surface component can comprise electrospun fibers which are formed and adapted to be ultraporous, for example at least 95% porous, with small fiber diameters, for example with electrospun fibers having a diameter less than 50 μm or less than 20 μm, which are parameters that cannot be provided by conventional memory foams. In one example, electrospun silicone can be used in the form of continuous fibers of chopped fibers mixed with other materials. Examples of electrospun silicones are found in the following articles, which are incorporated herein by this reference: Duan, Gaigai, et al, "Ultralight, Soft Polymer Sponges by Self-Assembly of Short Electrospun Fibers in Colloidal Dispersions" (https://doi.org/10.1002/adfm.201500001); (2) Haerst, Miriam et al, "Silicone Fiber Electrospinning for Medical Applications" (https://www.degruyter.com/downloadpdf/j/bmte.2014.59.issue-s1/bmt-2014-5000/bmt-2014-5000.pdf.

In another aspect of the invention, a container can be provided that is adapted for carrying any applicator of FIGS. 4 to 9. Such a container (not shown) can have a plurality of ports therein for allowing airflow into and through the applicator when stored therein. In one variation, the container can have a base portion and a cover portion connected by a hinge that can then be used to clamp the applicator into a collapsed position within the container. It should be appreciated that the container could be similar with the base portion being coupled is a screw-on cap. In another variation, the first container can be provided for a collapsible core portion as shown in FIGS. 4-5B the second container for carrying a flattened surface portion, which can be flattened sideways. In another aspect of the invention, the container carrying the flattened surface portion can carry a battery operably connected to heating elements therein, such as resistive heaters or LEDs for further speeding the drying process. In another variation, a fan carried within the container for providing heated airflow through the container to assist in the drying of the applicator. In still another variation, the container can carry LEDs that are configured to provide selected wavelengths of light to illuminate the applicator for various purposes. For example, LEDs with infrared light can be used to heat the applicator to assist in drying or LEDs that provide UV light can be used to sterilizable or otherwise kill bacteria on the surfaces of the applicator.

In general, a cosmetic applicator or blender corresponding to the invention comprises a resilient body shaped for gripping with the fingers of a user, a surface portion of the body comprising a porous memory foam having first inherent rebound characteristics for rebounding from a compressed tensioned shape to a repose memory shape and a core portion of the body comprising at least one spring element imparting to the body second rebound characteristics that differ from the first rebound characteristics inherent in the memory foam. Such a cosmetic applicator is configured with second rebound characteristics that have a faster rebound than the first rebound characteristics. More in particular, such a cosmetic applicator can have second rebound characteristics that are faster than said first rebound characteristics by a factor of at least 1.5 times faster, at least 2 times faster, at least 3 times faster or at least 5 times faster. In this variation, embodiment, the surface portion is typically detachably coupled to the core portion. Further, the interface between the surface portion and the core portion is fluid impermeable.

In general, the cosmetic applicator blender of the invention can be defined as having a ratio between the total interior volume of the surface portion of memory foam relative to the spatial volume of the resilient body is less that than 0.4:1, less than 0.3:1, less than 0.2:1 or less than 0.1:1. The at least one spring element can comprises a helical spring or a plurality of other specially shaped spring elements.

In general, a cosmetic applicator or blender corresponding to the invention comprises a resilient body having a central axis adapted and shaped for gripping with the fingers of a user, a surface portion of the body comprising a fluid permeable layer overlying a fluid impermeable layer and an interior portion of the body including at least one spring element for imparting to the body a selected rebound parameter for rebounding the body from a compressed tensioned shape to a decompressed repose shape. Typically, the plurality of spring elements are space apart around the central axis wherein such springs different spring strength and/or are asymmetrically space apart around the central axis.

In general, a cosmetic applicator or blender corresponding to the invention comprises a resilient compressible body having a central axis adapted and shaped for gripping with the fingers of a user, the body having a first compressibility parameter when compressed about the central axis and a second compressibility parameter when compressed at an angle relative to the central axis. In another variation, the body has at least a third compressibility parameter when compressed at a different angle for angles relative to the central axis. Typically, an interior portion of the body carries spring elements for providing the first and second compressibility parameters for additional compressibility parameters. Typically, the spring elements are spaced apart about the central axis of the applicator.

Although particular embodiments of the present invention have been described above in detail, it will be understood that this description is merely for purposes of illustration and the above description of the invention is not exhaustive. Specific features of the invention are shown in some drawings and not in others, and this is for convenience only and any feature may be combined with another in accordance with the invention.

Although particular embodiments of the present invention have been described above in detail, it will be understood that this description is merely for purposes of illustration and the above description of the invention is not exhaustive. Specific features of the invention are shown in some drawings and not in others, and this is for convenience only and any feature may be combined with another in accordance with the invention. A number of variations and alternatives will be apparent to one having ordinary skills in the art. Such alternatives and variations are intended to be included within the scope of the claims. Particular features that are presented in dependent claims can be combined and fall within the scope of the invention. The invention also encompasses embodiments as if dependent claims were alternatively written in a multiple dependent claim format with reference to other independent claims Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A cosmetic applicator comprising:

a resilient body having a central axis adapted and shaped for gripping with the fingers of a user;

a surface portion of the body comprising a fluid permeable layer overlying a fluid impermeable layer;

an interior portion of the body including a plurality of spring elements for imparting to the body a selected rebound parameter for rebounding the body from a compressed tensioned shape to a decompressed repose shape.

2. The cosmetic applicator of claim 1 wherein the plurality of spring elements is spaced apart about the central axis.

3. The cosmetic applicator of claim 2 wherein the plurality of spring elements is asymmetrically spaced apart about the central axis.

4. The cosmetic applicator of claim 2 wherein the plurality of spring elements differ in spring strength.

5. The cosmetic applicator of claim 2 wherein the plurality of spring elements differ in orientation relative to the central axis.

6. A cosmetic applicator comprising:

a resilient body shaped for gripping with the fingers of a user;

a surface portion of the body comprising a porous memory foam having a first inherent rebound characteristic to rebound from a compressed tensioned shape to a repose memory shape; and a core portion of the body comprising at least one helical spring element imparting to the body a second rebound characteristic that differ from the first inherent rebound characteristic.

7. The cosmetic applicator of claim 6 wherein the surface portion is detachably coupled to the core portion.

8. The cosmetic applicator of claim 6 wherein an interface between the surface portion and the core portion is fluid impermeable.

9. A cosmetic applicator comprising:

a resilient body shaped for gripping with the fingers of a user;

a surface portion of the body comprising a porous memory foam having a first inherent rebound characteristic to rebound from a compressed tensioned shape to a repose memory shape; and a core portion of the body comprising a plurality of spring elements imparting to the body a second rebound characteristic that differ from the first inherent rebound characteristic.

10. The cosmetic applicator of claim 9 wherein the surface portion is detachably coupled to the core portion.

11. The cosmetic applicator of claim 9 wherein an interface between the surface portion and the core portion is fluid impermeable.

* * * * *